United States Patent [19]

Karlsson

[11] 4,260,368

[45] Apr. 7, 1981

[54] PROCESS AND A DEVICE FOR TREATMENT OF BIOLOGIC FUELS

[76] Inventor: Einar L. Karlsson, Åbyn 1203, Burträsk, Sweden, S-930 20

[21] Appl. No.: 46,321

[22] Filed: Jun. 7, 1979

[30] Foreign Application Priority Data

Jun. 9, 1978 [SE] Sweden ..... 7806720

[51] Int. Cl.[3] ..... F27B 14/00; F27B 6/08

[52] U.S. Cl. ..... 432/1; 34/35; 432/13; 432/112; 432/113

[58] Field of Search ..... 432/1, 13, 112, 113, 432/118; 34/35

[56] References Cited

U.S. PATENT DOCUMENTS

| | | | |
|---|---|---|---|
| 712,258 | 10/1902 | Campbell | 432/112 |
| 1,920,677 | 8/1933 | Burke | 432/118 |
| 2,014,764 | 9/1935 | Gram | 34/35 X |
| 2,500,553 | 3/1950 | Lykken | 432/112 X |

*Primary Examiner*—John J. Camby

*Attorney, Agent, or Firm*—Cushman, Darby & Cushman

[57] ABSTRACT

This invention relates to a process and a device for treatment, comprising at least drying, of preferably peat and the object thereof is reduction of the moisture percentage to the lowest possible level with a low supply of energy and simultaneously making the peat so compact in dried state that it can be easily stored, conveyed and handled and does not give off dust. According to the invention the material (13) to be dried is heated to such an extent that the water therein will boil and vaporize, the vapour formed being carried away from the material by means of air (15) streaming through this, which air is led to a heat exchanger (20) for heating supply air from outside, which is utilized to form the air stream (15) through the material, and for heating of the combustion air to a combustion furnace (8), the fumes (11) of which are utilized for heating the material.

14 Claims, 3 Drawing Figures

PROCESS AND A DEVICE FOR TREATMENT OF BIOLOGIC FUELS

This invention relates to a process for treatment, comprising at least drying, of peat and other decomposed biological fuels and a device for carrying out the process.

As is known, peat has been used and is still used in some countries as fuel and seems to become more and more interesting as an alternative fuel to conventional fuels. As the peat in its natural state contains large amounts of water it must be drained and dried to be useful at all as a fuel, which has so far been carried out in such a way that after drainage and planning of a turbary this is cut over the whole leveled area to a depth of some cm and the peat thus cut is left to dry in the sun, possibly with turning.

By this way of draining and drying peat one is quite dependent on weather and wind, and at an unfavourable state of the weather it may take a very long time to reduce the moisture percentage of the peat to such a degree that the peat will be useful as a fuel, i.e. down to about 50%.

By draining and drying raw peat in a stack, which as distinguished from the above-mentioned peat cutting method makes possible working of peat throughout the year, it has, however, been found possible to reduce the moisture percentage relatively fast to about 60–40%, at least in the surface layer of the stack, but for reducing the moisture percentage below e.g. 40% favourable weather conditions are required also according to the stack method.

In view of fuel but also for reasons of storage and conveying technique it is, however, desirable to be able to reduce the moisture percentage in peat to a level of 20–10% or lower at low costs and a low supply of energy, and therefore it is the object of the present invention to provide a process for primarily drying of peat, which satisfies these demands to the highest possible degree and, moreover, makes possible such a treatment of the peat that it will have a compact form in dried state, which is easy to store, to transport and to handle and does not give off dust in any large degree, as well as a device for carrying out the process.

This object is achieved by the process and the device of the invention having the characteristic features set out in the claims.

Figure 1:
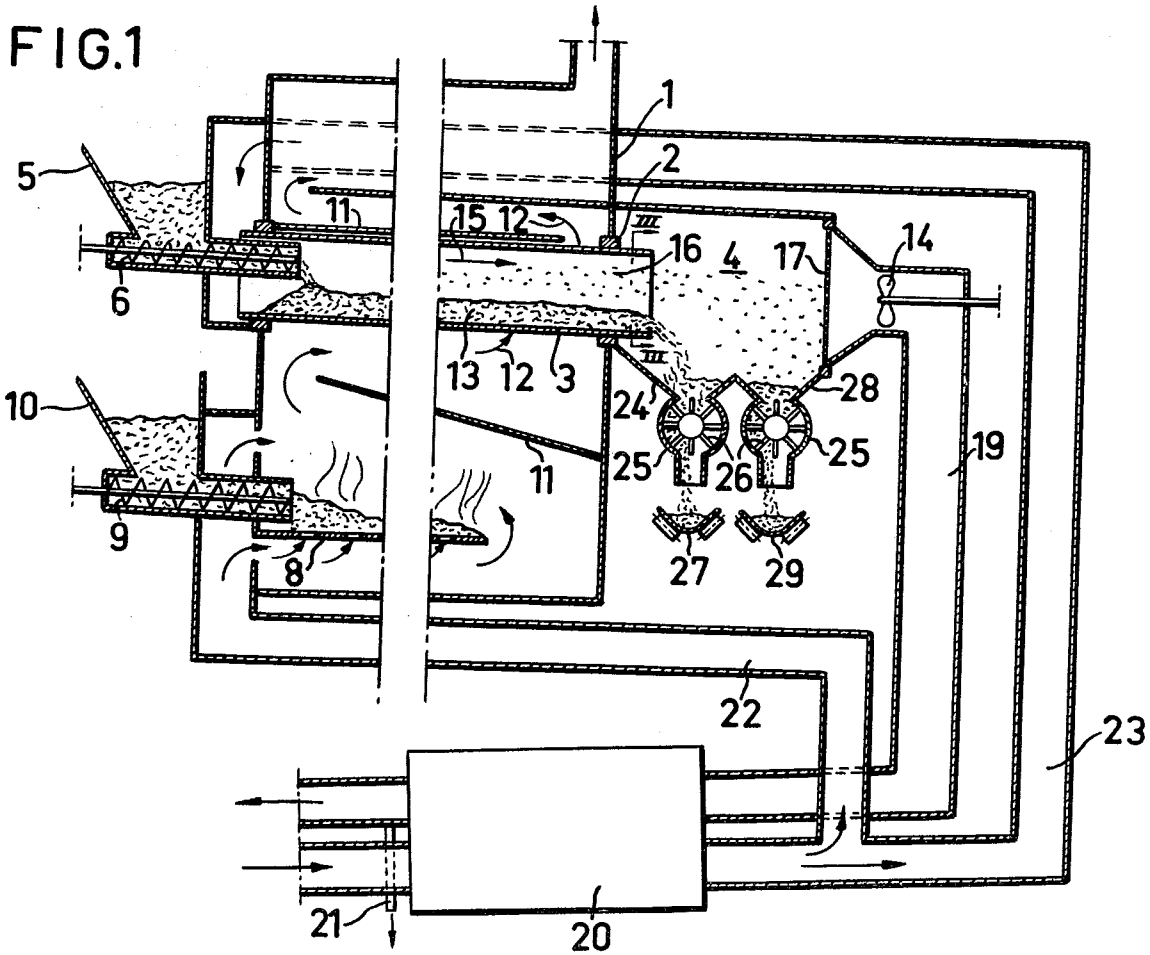
Figure 2:
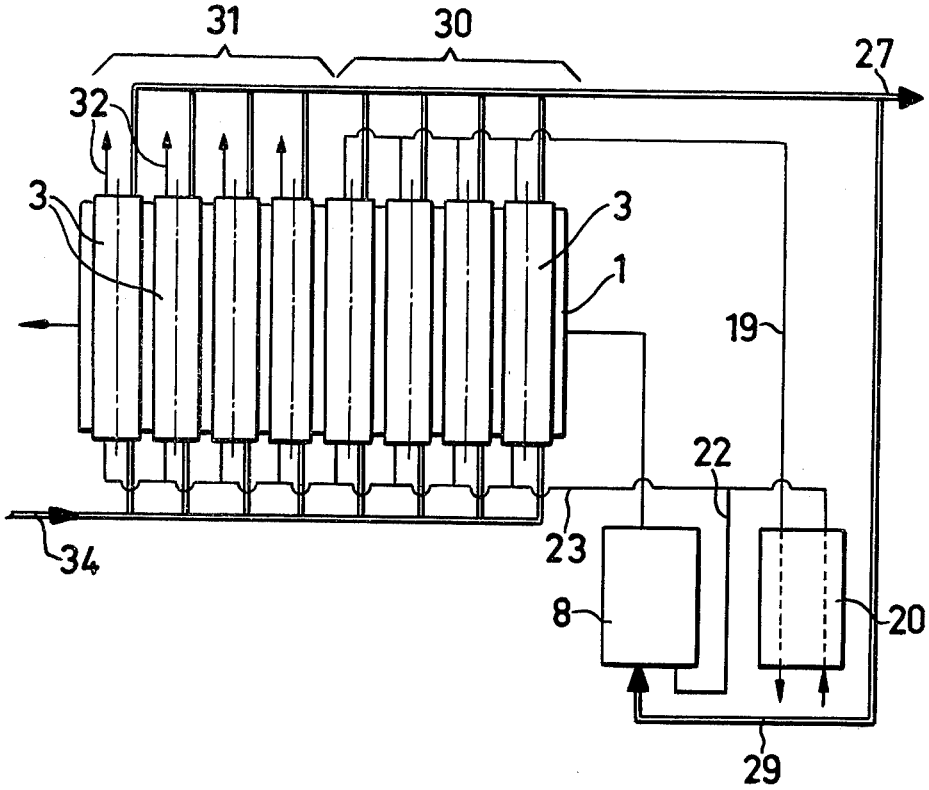
Figure 3:
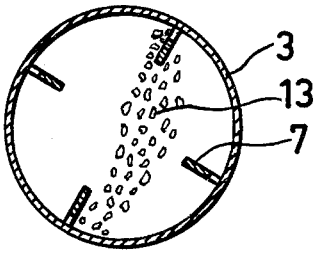

The invention is described in the following more in detail with reference to the enclosed drawings, in which FIG. 1 shows schematically a simple plant only to illustrate the principle on which the invention is based, FIG. 2 shows also schematically a preferred embodiment of the peat drying plant according to the invention, and FIG. 3 shows a section along the line III—III through a rotary dryer.

1 designates generally a suitably insulated drying house, containing at least one rotary dryer 3 mounted in bearings 2, which is inclined to some extent in a direction from its intake end and towards its discharge end leading out into a discharge section 4 of the housing 1 for dried peat. The rotary dryer 3 is charged with peat to be dried from a peat container 5 through a charging conveyor 6, which can be of screw type or another type making possible adjustment of the fed amount of peat all according to needs, i.e. according to the drying capacity of the rotary dryer. As is shown in FIG. 3, the rotary dryer 3 is preferably provided on its inside with longitudinal lifting means for stirring of the peat 13 in the dryer, which peat is brought to move due to the inclination and rotation of the dryer from the intake end of the dryer to its discharge end at a velocity adapted to the drying velocity.

Fumes from a fireplace 8 for fuel in the form of completely or partly dried peat pass the rotary dryer 3 on its outside. The peat fuel is fed into the fireplace 8 by means of a fuel conveyor 9 with adjustable velocity, e.g. of screw type, from a fuel container 10. The hot fumes from the fireplace 8 are brought by shields 11 or the like to sweep against the outside of the rotary dryer along the whole or major part of its length, as schematically shown by means of the arrows 12 in FIG. 1, and to heat the peat 13 in the rotary dryer so that the water therein is brought to boil and vaporize and therefore leaves the peat in the form of saturated or superheated vapour.

A stream 15 of preheated air generated by one or more fans 14 is led continuously at a relatively low velocity adjustable by means of the fans 14 according to need. The air stream brings along the water steam formed in the rotary dryer 3 and also light peat particles 16, such as peat dust and the like, which are whirled up due to the rotation of the dryer. The air stream 15 serving as carrier for water vapour and peat particles is then lead via the discharge section 4 and a preferably self-cleaning filter 17 serving as a wall therein, e.g. a vibrating filter, into a discharge conduit 19 and to a heat exchanger 20, e.g. of counter current type, for heating of air supplied from outside. The condensate formed by condensation in the heat exchanger 20 is led off through an outlet 21. The heated supply air from the heat exchanger 20 is carried to the fireplace via a conduit 22 for preheating of the combustion air, and to the rotary dryer 3 via a conduit 23 to form said stream 15 of preheated air through the rotary dryer 3. In this way the heat generated in the fireplace is utilized in a very effective way for drying of the peat.

The peat in the rotary dryer 3 is dried so to speak by evaporation of its water and the peat released from water in this way will have a high density, becomes compact and will have the form of small compact pieces similar to pellets due to the rotation of the dryer, the size of said pellets being to some extent dependent on the piece size of the fed peat. The pellets are very easy to handle and do not give off dust in any appreciable degree, as the light peat particles and the peat dust are separated during the motion of the peat through the rotary dryer 3 in a way indicated previously.

The peat in the discharge section 4 is thus discharged from the rotary dryer 3 and falls down therein into a first shaft 24, from which the heated peat similar to pellets is discharged by means of an impeller tight against enclosing walls 25 to a conveyor 27, which feeds the dried peat further to a store. The discharge velocity of the impeller should be adapted so that the impeller 26 is always filled with peat and so that there is also a peat layer above the impeller to prevent air outflow through the shaft 24.

The light peat particles accompanying the air stream 15 through the rotary dryer 3 are separated from this by the filter 17 functioning as a wall in the discharge section and fall down in a second shaft 28 with the same discharge device 25, 26 as the first shaft 24 to prevent air outflow through the shaft 28, which discharges the particulate peat on a conveyor 29, which should be quite encapsulated and transports the peat discharged from the shaft 28 to the fireplace 8, where it is used as fuel, possibly together with other peat or other fuel, if required.

In FIG. 2 an example of a peat drying plant according to the invention is shown, which can be mobile for use in the field and e.g. in direct connection with a turbary. This plant comprises a series of several rotary dryers 3 of the aforesaid type arranged in sequence and each having an individual charging device 5, 6 and a discharge section 4, which, however, can be common to all the dryers 3 but need not be so. All the rotary dryers 3 are exposed to fumes from a combustion furnace—or boiler 8, as is shown as arranged separately in FIG. 2, and the peat in the rotary dryers 3 is heated through the fumes for drying. As the fumes are hotter at the beginning of the series than at its end the drying capacity is higher in the rotary dryers 3 located closest to the boiler 8 and these dryers are also the high-energy portion 30 of the series, while the remaining rotary dryers are low energy portion 31 thereof. The air stream from the rotary dryers 3 in the high energy portion 30 is led through the conduit 19 to the heat exchanger 20 for heating of the supply air coming from outside, which is led from the heat exchanger 20 to the boiler 8 for preheating of the combustion air via the conduit 22, and to each of the rotary dryers 3 included in the series via the conduit 23 to form the preheated air stream through these. The outgoing air stream 32 from the dryers 3 in the low energy portion 31 is led to the open air, as shown in FIG. 2, but also this air containing some energy can be led to a heat exchanger not shown in the drawing for heating of the supply air to another low energy portion arranged after the low energy portion shown and comprising a number of rotary dryers.

Peat to be dried in the rotary dryers 3 is fed to the peat containers not shown in FIG. 2 by means of a conveyor 34 and the dried peat is fed, as previously mentioned, to the boiler 8 by means of the conveyor 29 and to a store by means of the conveyor 27.

A rapid and effective drying of peat with a possibility of utilizing waste peat as fuel for the drying process is achieved by means of the present invention, and at the same time conversion of the peat to a homogenized, easily handable and storable peat fuel with a moisture percentage and a high fuel value is made possible. It has been found through the process and the device according to the invention that peat with a moisture percentage of up to 70% can be dried to a moisture percentage of below 5% in less than one hour and with a consumption of peat as fuel which does not even amount up to 20% of the supplied amount of peat.

This invention is not restricted to what is described above and shown in the drawings but can be changed, modified and supplemented in many different ways within the scope of the inventive thought indicated in the claims. Thus the air stream through the rotary dryers need not have the same motion of direction as the peat but can have an opposite direction thereto. The fan or fans need not be placed as shown in the drawings, either, but may have any other suitable location, and, moreover, one or more motors are included in the device for driving the rotary dryers, the fans etc even if this has not been shown and described specifically.

What I claim is:

1. A process for treating peat comprising: burning a fuel to produce a stream of hot combustion gases; drying the peat by passing the stream of hot combustion gases in indirect heat exchange with the peat to thereby heat the peat to a temperature sufficient to vaporize water from the peat and to form a stream of hot vapour; passing the stream of hot vapor in heat exchange relationship with a stream of outside air to heat the stream of outside air; passing at least a portion of the stream of heated outside air to the burning fuel as combustion air.

2. A process as in claim 1 including passing a portion of the stream of heated outside air through the peat being heated so as to mix with the vapor.

3. A process as in claim 1 including agitating the peat while being heated.

4. A process as in claim 2 or claim 3 including separating light particles of peat released during heating of the peat, collecting the separated particles, passing the collected particles as fuel to the burning operation, and passing the remaining portion of the dried peat to storage.

5. A process as in claim 2 including imparting a translating motion to the peat during heating in the same direction as the air stream passing through the peat.

6. A process as in claim 2 including imparting a translating motion to the peat during heating in the opposite direction as the air stream passing through the peat.

7. A process as in claim 1 wherein vapor is condensed during said heat exchange between vapor and outside air.

8. A process for treating peat comprising: passing a stream of the peat to the inlet end of a rotary dryer; burning a fuel in a furnace to produce a stream of hot combustion gases; passing the stream of hot combustion gases over the exterior of the rotary dryer to thereby heat the peat to a temperature sufficient to vaporize water therefrom; passing dried peat from the discharge end of the rotary dryer to storage; passing vapor from the rotary dryer in heat exchange relationship with a stream of outside air to heat the stream of outside air and to condense the vapor; passing a portion of the stream of heated outside air to the furnace as combustion air; passing another portion of the stream of heated outside air through the interior of the rotary dryer to remove the water being vaporized from the peat; filtering light particles of peat from the vapor leaving the rotary dryer before the vapor passes to heat exchange with outside air; collecting the light particles of peat separately from the dried peat leaving the discharge end of the rotary dryer; and passing the collected light particles to the furnace as fuel.

9. Apparatus for treating peat comprising: a combustion furnace for burning fuel; a rotary dryer having an inlet and an outlet; means for feeding peat to the inlet; means for passing hot combustion gases from the furnace over the exterior of the rotary dryer to heat the peat therein to a temperature sufficient to vaporize water from the peat whereby dried peat is discharged from the outlet of the rotary dryer; means for passing vapor from the peat in the rotary dryer to a heat exchanger; means for passing a stream of outside air to the heat exchanger whereby the stream of outside air becomes heated; means for passing at least a portion of the heated outside air from the heat exchanger to the furnace as combustion air.

10. Apparatus as in claim 9 including means for passing a portion of the heated outside air from the heat exchanger into the rotary dryer.

11. Apparatus as in claim 9 wherein said rotary dryer is an inclined hollow cylinder rotating about its axis.

12. Apparatus as in claim 10 including a filter arranged in the vapor stream between the rotary dryer and the heat exchanger for filtering light particles of peat from the vapor stream; and means for collecting and transporting the filtered light particles to the furnace as fuel.

13. Apparatus as in claim 9 wherein there is a series of rotary dryers; means for passing hot combustion gases to the first dryer in the series and thereafter to the other dryers in sequence, said first dryer having associated therewith said means for passing vapor from the dryer to the heat exchanger; and means associated with at least one other dryer in the series for bypassing vapor from said other dryer past the heat exchanger and discharging the bypassed vapor to atmosphere.

14. Apparatus as in claim 9 including means for passing at least a portion of the heated outside air from the heat exchanger through the dryer to aid in removing water vapor from the peat while being heated.

* * * * *